US007451812B2

(12) United States Patent
Cooper et al.

(10) Patent No.: US 7,451,812 B2
(45) Date of Patent: Nov. 18, 2008

(54) REAL-TIME AUTOMATED HETEROGENEOUS PROPPANT PLACEMENT

(75) Inventors: Iain Cooper, Sugar Land, TX (US); Dean M. Willberg, Tucson, AZ (US); Matthew J. Miller, Cambridge (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 50 days.

(21) Appl. No.: 11/613,693

(22) Filed: Dec. 20, 2006

(65) Prior Publication Data

US 2008/0149329 A1 Jun. 26, 2008

(51) Int. Cl.
*E21B 43/267* (2006.01)

(52) U.S. Cl. ..... 166/250.1; 166/250.01; 166/280.1; 166/308.1; 703/10

(58) Field of Classification Search ..... None
See application file for complete search history.

(56) References Cited

U.S. PATENT DOCUMENTS

| | | | |
|---|---|---|---|
| 6,776,235 | B1 | 8/2004 | England |
| 6,847,034 | B2 | 1/2005 | Shah |
| 6,876,959 | B1 | 4/2005 | Peirce |
| 6,978,832 | B2 | 12/2005 | Gardner |
| 6,993,432 | B2 | 1/2006 | Jenkins |
| 7,013,976 | B2 | 3/2006 | Nguyen |
| 7,017,665 | B2 | 3/2006 | Nguyen |
| 7,021,379 | B2 | 4/2006 | Nguyen |
| 7,028,774 | B2 | 4/2006 | Nguyen |
| 7,032,667 | B2 | 4/2006 | Nguyen |
| 7,059,406 | B2 | 6/2006 | Nguyen |
| 7,063,150 | B2 | 6/2006 | Slabaugh |
| 7,063,151 | B2 | 6/2006 | Nguyen |
| 7,066,258 | B2 | 6/2006 | Justus |
| 7,073,581 | B2 | 7/2006 | Nguyen |
| 7,082,993 | B2 | 8/2006 | Ayoub |
| 7,111,681 | B2 | 9/2006 | Detournay |
| 7,114,560 | B2 | 10/2006 | Nguyen |
| 7,114,570 | B2 | 10/2006 | Nguyen |
| 7,131,493 | B2 | 11/2006 | Eoff |
| 7,156,194 | B2 | 1/2007 | Nguyen |
| 7,216,711 | B2 | 5/2007 | Nguyen |
| 7,237,609 | B2 | 7/2007 | Nguyen |

(Continued)

FOREIGN PATENT DOCUMENTS

| | | | |
|---|---|---|---|
| WO | 2004009956 | A1 | 1/2004 |

*Primary Examiner*—Zakiya W. Bates
(74) *Attorney, Agent, or Firm*—David Cate; Rdàn Nava; Dale Gaudier

(57) ABSTRACT

A system and a method for heterogeneous proppant placement in a fracture (12) in a subterranean formation (18) are disclosed. The system includes a delivery system (10) for delivering proppant and treatment fluid to the fracture (12), a sensor (20) for measuring geometry of the fracture and a computer (24) in communication with the sensor (20). The computer (24) includes a software tool for real-time design of a model (38) for heterogeneous proppant placement in the fracture (12) based on data from the sensor (20) measurements and a software tool for developing and updating a proppant placement schedule (42) for delivering the proppant and treatment fluid to the fracture (12) corresponding to the model. A control link between the computer (24) and the delivery system (10) permits the delivery system (10) to adjust the delivery of the proppant and treatment fluid according the updated proppant placement schedule.

41 Claims, 6 Drawing Sheets

U.S. PATENT DOCUMENTS

2003/0205376 A1 11/2003 Ayoub
2004/0226715 A1 11/2004 Willberg
2005/0115711 A1* 6/2005 Williams et al. ..... 166/308.1
2005/0183858 A1 8/2005 Ayoub

* cited by examiner

REAL-TIME AUTOMATED HETEROGENEOUS PROPPANT PLACEMENT

FIELD OF THE INVENTION

The invention relates generally to the art of hydraulic fracturing in subterranean formations and more particularly to a system and method for improving fracture conductivity with heterogeneous proppant placement.

BACKGROUND

The statements in this section merely provide background information related to the present disclosure and may not constitute prior art.

Hydraulic fracturing is a primary tool for improving well productivity by placing or extending high-permeability flow passages from the wellbore to the reservoir. This operation is essentially performed by hydraulically injecting a fracturing fluid into a wellbore penetrating a subterranean formation and forcing the fracturing fluid against the formation strata by pressure. The formation strata or rock is forced to crack and fracture. Proppant is placed in the fracture to prevent the fracture from closing and thus, provides improved flow of the recoverable fluid, i.e., oil, gas or water.

The success of a hydraulic fracturing treatment is related to the fracture conductivity, which is the ability of fluids to flow from the formation through the proppant pack. In other words, the proppant pack or matrix must have a high permeability relative to the formation for fluid to flow with low resistance to the wellbore.

In traditional fracturing operations, techniques have been used to increase the permeability of the proppant pack by increasing the porosity of the interstitial channels between adjacent proppant particles within the proppant matrix. These traditional operations seek to distribute the porosity and interstitial flow passages as uniformly as possible in the consolidated proppant matrix filling the fracture, and thus employ homogeneous proppant placement procedures to substantially uniformly distribute the proppant and non-proppant, porosity-inducing materials within the fracture.

A recent approach to improving hydraulic fracture conductivity has been to try to construct proppant clusters in the fracture, as opposed to constructing a continuous proppant pack. U.S. Pat. No. 6,776,235 (England) discloses a method for hydraulically fracturing a subterranean formation involving alternating stages of proppant-containing hydraulic fracturing fluids contrasting in their proppant-settling rates to form proppant clusters as pillars that prevent fracture closing. This method can, for example, alternate the stages of proppant-laden and proppant-free fracturing fluids to create proppant clusters in the fracture and open channels between them for formation fluids to flow. Thus, the fracturing treatments result in a heterogeneous proppant placement (HPP) and a 'room-and-pillar' configuration in the fracture, rather than a homogeneous proppant placement and consolidated proppant pack. The amount of proppant deposited in the fracture during each HPP stage is modulated by varying the fluid transport characteristics (such as viscosity and elasticity), the proppant densities, diameters, and concentrations and the fracturing fluid injection rate.

Proppant placement techniques based on the fracture geometry have been developed for use during traditional proppant pack operations. However, proppant placement in HPP is considerably more challenging and the art is still in search of ways to improve the proppant placement techniques in HPP operations. In practice, a predetermined proppant pumping schedule was followed presuming the desired fracture geometry would result. There is a need in the art of HPP operations for real-time evaluation of the actual fracture geometry and, if needed, a way to modify or adjust a proppant placement schedule to improve the ultimate fracture geometry.

SUMMARY OF THE INVENTION

The present invention can achieve heterogeneous proppant placement (HPP) in a fracture in subterranean formation using an automated procedure and system with real-time feedback based on measuring fracture geometry as the fracture treatment progresses to update the proppant placement schedule. The idealized, predictive model of proppant placement can be updated with observed proppant placement and the proppant injection parameters adjusted accordingly during the fracture operation. The invention thus succeeds more often and to a greater extent to improve the conductivity of the fracture for the flow of formation fluids to the production well.

A system embodiment for heterogeneous proppant placement in a fracture in a subterranean formation can include a delivery system for delivering proppant and treatment fluid to the fracture, a sensor for measuring geometry of the fracture, and a computer in communication with the sensor. The computer can include a software tool for real-time design of a model for heterogeneous proppant placement in the fracture based on data from the sensor measurements, and a software tool for developing and updating a proppant placement schedule for delivering the proppant and treatment fluid to the fracture corresponding to the model. There can be a control link between the computer and the delivery system for delivery of the proppant and treatment fluid according the updated proppant placement schedule.

In an embodiment, the delivery system can include a pump, mixer, blender, or the like. In an embodiment, the blender can include a programmable optimum density (POD) blender, a tub blender, or the like or a combination thereof.

In an embodiment, the sensor can include a pressure sensor, seismic sensor, tilt sensor, radioactivity sensor, magnetic sensor, electromagnetic sensor, and the like or a combination thereof. An embodiment can include an array of sensors.

In an embodiment, the delivery system can include a noisy particulate material and the sensor can include a noise sensor for detecting detonation, ignition or exothermic reaction of the noisy particulate material.

In an embodiment, the system can include a position transmitter associated with the sensor and a receiver in communication with the computer for receiving data from the transmitter.

A method embodiment of heterogeneous proppant placement in a subterranean formation can include the steps of: (a) designing an initial model for heterogeneous proppant placement in a fracture in the formation; (b) developing an initial proppant placement schedule for delivering proppant and treatment fluid to the fracture predicted to obtain the initial model; (c) beginning delivery of the proppant to the fracture according to the initial proppant placement schedule; (d) taking fracture geometry measurements during the proppant delivery; (e) updating the model according to the geometry measurements; (f) updating the proppant placement schedule according to the updated model and delivering the proppant according to the updated proppant placement schedule; and (g) repeating steps (d) through (f) to complete the proppant delivery.

In an embodiment, parameters for the model can include formation mechanical properties such as Young's modulus, Poisson's ratio, formation effective stress, and the like and a combination thereof.

In an embodiment, the proppant can be delivered in slugs. The proppant placement schedule can include slugs of proppant alternated with a proppant-lean fluid. An embodiment can include phasing the delivery of the proppant in a programmable optimum density (POD) blender, a tub blender, or the like or a combination thereof. An embodiment can include varying a fluid delivery flowrate. In an embodiment, the delivery can include automatically controlling pumping and blending of proppant and treatment fluid.

In an embodiment, the design and updating of the model can include determining the amount of proppant for delivery and/or determining the fracture dimensions.

In an embodiment, the treatment fluid can include a heterogeneity trigger for heterogeneous proppant placement. The heterogeneity trigger can be a chemical reactant heterogeneity trigger and/or a physical heterogeneity trigger. In an embodiment, the heterogeneity trigger can include fibers.

An embodiment can include forming clusters of proppant with open channels between the clusters.

In an embodiment, the proppant placement schedule can further include varying a proppant concentration profile in the treatment fluid, which can be varied according to a dispersion method.

In an embodiment, the proppant concentration profile can be varied to inhibit the formation of pinch points.

In an embodiment, the geometric measurements can include seismic monitoring.

In an embodiment, updating the model can include determining fracture growth according to material balance calculations, pressure response measurements, seismic event measurements, and the like or a combination thereof.

An embodiment can further include allowing the fracture to close. An embodiment can further include producing fluids from the formation.

DETAILED DESCRIPTION

The description and examples are presented solely for the purpose of illustrating the preferred embodiments of the invention and should not be construed as a limitation to the scope and applicability of the invention. While the compositions of the present invention are described herein as comprising certain materials, it should be understood that the composition could optionally comprise two or more chemically different materials. In addition, the composition can also comprise some components other than the ones already cited. In the summary of the invention and this detailed description, each numerical value should be read once as modified by the term "about" (unless already expressly so modified), and then read again as not so modified unless otherwise indicated in context.

"Real-time" measurements refer to measurements wherein the data are transmitted to the surface shortly after being recorded, and does not necessarily include all recorded measurement data. In the present invention, real-time measurements can be taken during the fracturing operation to update the proppant placement operation to control the ultimate fracture geometry. "Microseismic" or "passive seismic" refers to faint earth tremors. "Noisy particulate material" means material small enough to be pumped during a fracturing treatment but sufficiently energetic to generate a signal that can be detected by geophones or accelerometers mounted in a well being fractured, in one or more observation wells, or on the surface.

Heterogeneous proppant placement (HPP) is a radical departure from traditional hydraulic fracturing treatment methods. U.S. patent application Ser. No. 11/608,686 to Lesko, et al. discloses an HPP method and composition and is hereby incorporated by reference herein. In a traditional fracturing treatment, a proppant pack serves two roles: keeping a fracture propped open, and providing a porous path for fluid flow in the fracture. As with traditional fracturing treatments, the proppant in an HPP treatment is designed to keep the fracture open, but in a different way than with traditional fracturing treatments. In an HPP treatment, the proppant is placed throughout the fracture and can form clusters of proppant with open channels between the clusters. When the fracture is allowed to close, the clusters can act as pillars to keep fracture propped open. However, the proppant clusters are not necessarily designed to be permeable. Unlike the hydraulic conductivity of interstitial proppant packs of traditional fracturing treatments, the hydraulic conductivity of the HPP fracture can be through the open channels. Thus HPP conductivity can be very high since there is minimal obstruction to flow in the open channels.

Figure 1:
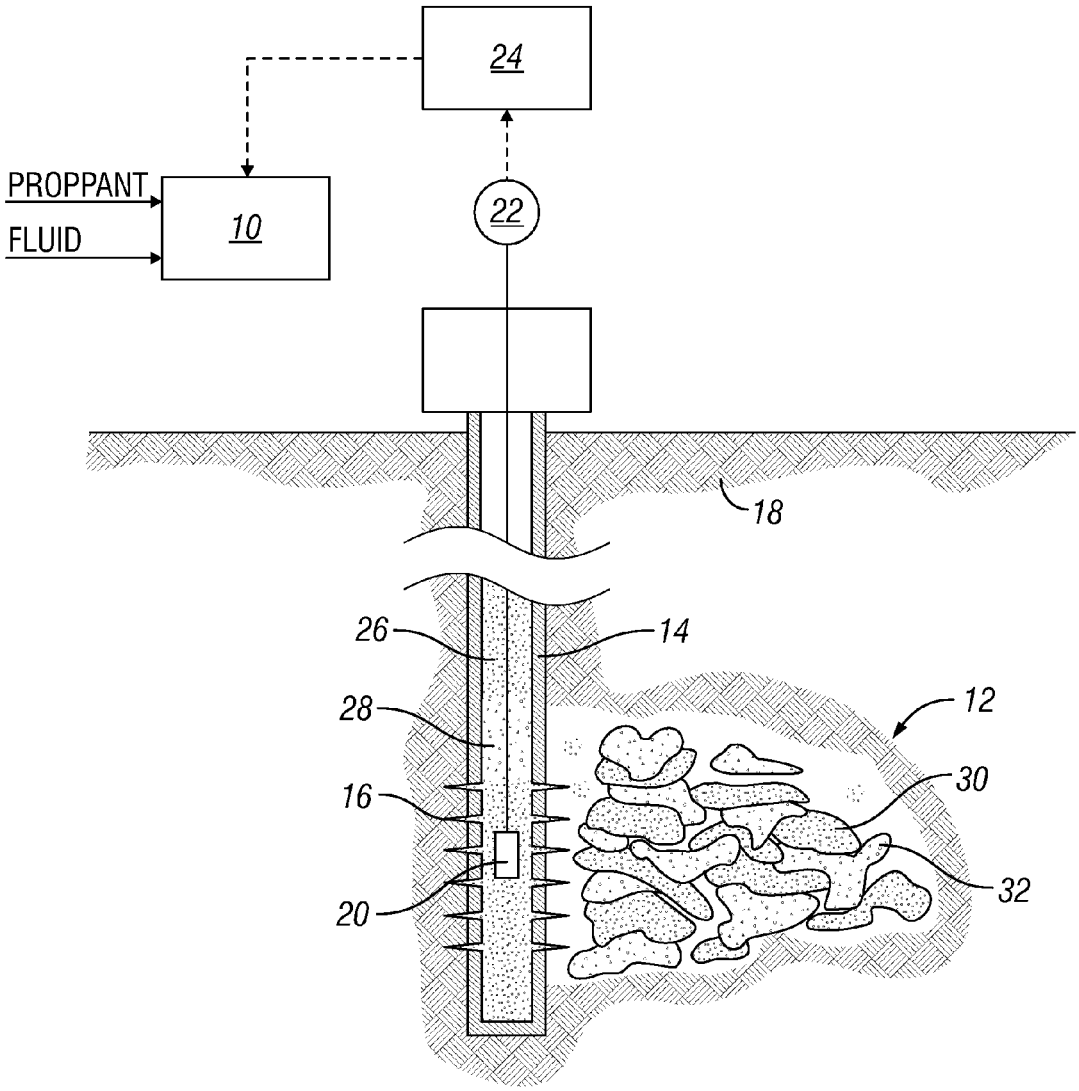
FIG. 1 schematically illustrates the relationship of heterogeneous proppant placement (HPP) system components according to an embodiment of the invention.

A simplified schematic of an HPP system according to an embodiment of the invention is illustrated in FIG. 1. A delivery system 10, for example, a pump and a blender, is provided to deliver proppant and treatment fluid to the fracture 12 via wellbore 14 and perforations 16 completed in formation 18. A sensor 20 is positioned to take measurements for determining the geometry of the fracture 12. The sensor 20 can be linked to sensor data processor 22 to communicate these measurements to a computer 24. A control link between the computer 24 and the delivery system 10 permits the delivery system to adjust the delivery of the proppant and treatment fluid according the updated proppant placement schedule. Proppant slugs 26 can be injected by the delivery system 10 to obtain regions in the wellbore 14, for example, of concentrated proppant particles separated from proppant-lean slugs 28 that can include non-proppant particles. In the fracture 12, the proppant particles can form proppant clusters 30 spaced apart by proppant lean regions 32, which can include, for example, removable particles such as fibers.

The proppant delivery system 10 can typically include tanks and lines for preparing and supplying the fracture treatment fluid and any additives, a precision continuous mixer (PCM) for polymer or gel hydration, a programmable optimum density (POD) blender, a tub blender, or the like or a combination thereof for supplying proppant and/or other solid additives in controlled rates, high pressure positive displacement pumps, and the like. The proppant delivery system 10 can be automated to vary fluid delivery flowrate and, additionally or alternatively, to facilitate controlled pulsing of the proppant and/or other additives such as fibers to follow a prescribed proppant placement schedule to promote conditions conducive for pillar creation from the proppant slugs once they reach the fracture.

The sensor 20 can be a pressure sensor, seismic sensor, including active acoustic seismic source particle location sensors, tilt sensor, radioactivity sensor, magnetic sensor, electromagnetic sensor, temperature sensor, including distributed temperature sensors (DTS), pressure sensor, including fiber-optic bottom hole pressure sensors, and the like, or a combination thereof. For increased measurement accuracy, the sensor 20 can include an array of different types of sensing elements. Greater accuracy can be achieved, for example, by determining the mean average of readings from a plurality of a particular kind of sensor, or by factoring multiple sensor readings into other techniques of statistical analysis. The sensor 20 can be placed in a wellbore being treated, in a lateral originating from the wellbore, on the surface, in an observation well, or the like or a combination thereof. In one embodiment, borehole seismic tools and/or tiltmeter tools can monitor the fracture growth with microseismic measurements. The sensor 20 can be a wireline tool deployed on coiled tubing, for example, into a well to be fractured, using a packer or other isolation mechanism, such as the OMEGA LOCK tool available from Vetco, where desired to minimize direct pumping noise and/or to inhibit sanding around the sensor 20.

There are several suitable options for a control link, including electric, infrared, pneumatic, and the like and combinations thereof. In some embodiments, the link between the computer and the delivery system 10 can involve a programmable logic controller (PLC), a distributed control system (DCS), and the like or a combination thereof.

In some treatments, a noisy particulate material can be included with the proppant or, alternatively or additionally, placed into a wellbore during an un-propped stage, and the sensor 20 can include a sensor for detecting a detonation, ignition or exothermic reaction of the noisy particulate material can be used. The material can be, for example, explosive, implosive or rapidly combustible. U.S. Pat. No. 7,134,492 (Willberg, et al.) discloses a method of treating a subterranean formation using a noisy particulate material and is hereby incorporated by reference herein.

In other treatments, a device for actively transmitting data for locating the position of the transmitting device can be used and the sensor 20 is adapted to receiving the transmitted data. Suitable transmitting devices can be electronic devices, such as radio frequency or other EM wave transmitters, acoustic devices, such as ultrasonic transceivers, and the like or a combination thereof. U.S. Pat. No. 7,082,993 B2 (Ayoub, et al.) discloses a fracturing method which includes the use of an actively transmitting device and is hereby incorporated by reference herein.

Figure 2:
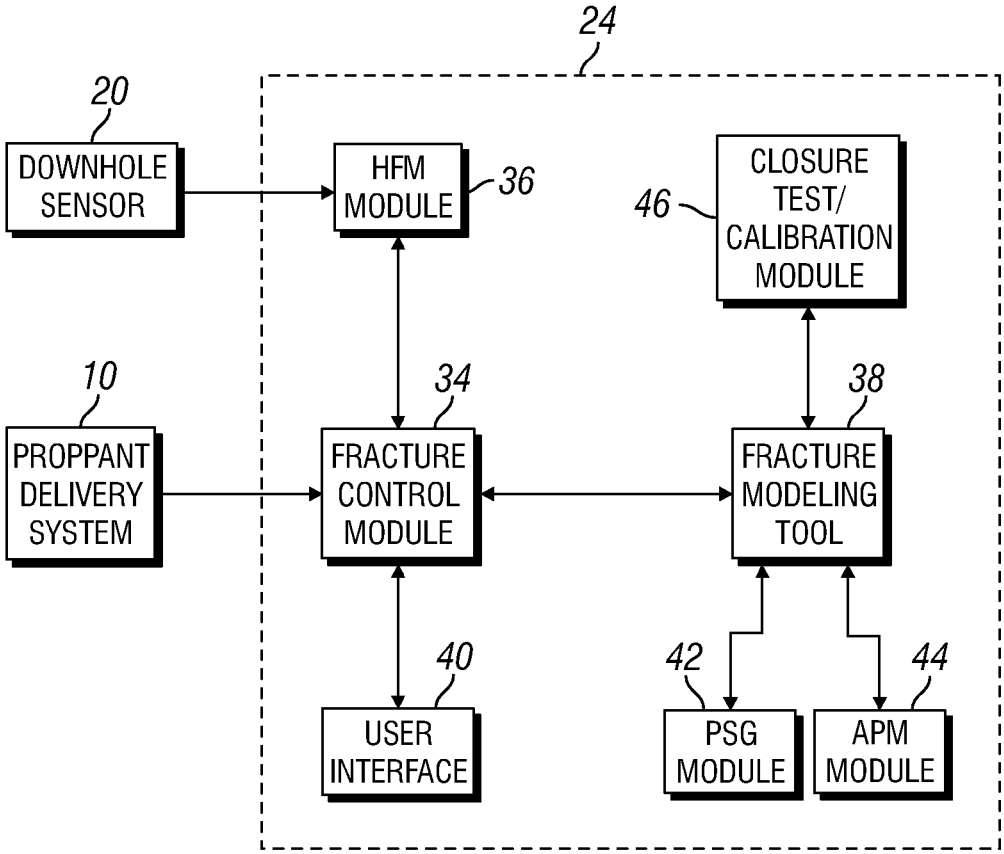
FIG. 2 schematically illustrates the computer software and inputs according to an embodiment of the invention.

A schematic of an HPP computer system 24 according to an embodiment of the invention is illustrated in FIG. 2. The system 24 can work in conjunction with a local area network (LAN) environment, which enables networking of PCs at the wellsite and can also provide a connection to the Internet through satellite or cellular telephone technology. Internet connectivity can provide the ability to transmit real-time data from the remote wellsite to anywhere in the world for real-time analysis and remote control, if desired.

Examples of a suitable computer 24 include a mainframe computer or a PC with sufficient processor speed and memory to inhibit lagging or crashing while the computer receives input from the sensor 20, runs software packages and controls the delivery system 10. The computer 24 does not necessarily have to be a high-end model, although the real-time aspect of modeling can be enhanced by a faster computer.

The system 24 can include a fracture control module 34 for monitoring, recording, controlling and reporting real-time data for the HPP stimulation treatment, operatively connected with a hydraulic fracture monitoring (HFM) module 36, fracture modeling tool 38 and a user interface 40. The control module 34 can interface with the proppant delivery system 10 to control the injection of treatment fluid, proppant and other additives into the fracture. Operator control through module 34 is also available via the user interface 40. Various software tools are commercially available for the control module 34, either as licensable modules or as part of a well treatment system, such as, for example, the fracturing computer-aided treatment system available from Schlumberger Oilfield Services under the trade designation FRACCAT.

In the system 24 of this embodiment, the control module 34 can provide the user interface 40 with real-time detailed job information, including, for example, real-time displays, plots, surface schematics and wellbore animations, as desired. During the job, the control module can track the treatment design and display actual job parameters compared to planned values. The control module 36 can also use the design to simultaneously control proppant and additive concentrations via a plurality of blenders, pumps, tanks, etc., in the proppant delivery system 10. This control capability ensures that actual concentrations and rates follow the plan.

The HFM module 36 receives and interprets data from sensor 20 and other sources to determine the fracture geometry, including height, length, and azimuth, for example, and reports the data to the control module 34 to monitor the progression of the geometry in real-time. Various software tools are commercially available for HFM module 36, either as licensable modules or as part of an HFM service, such as, for example, the HFM service available from Schlumberger Oilfield Services under the trade designation STIMMAP. The HFM modules commercially available for use with homogeneous proppant placement can be appropriately modified by the skilled artisan for interpretation of pillar and channel location data in an HPP job, which can include microseismic event data from the sensor 20 as well as pressure related pumping data received via the fracture control module 34.

The fracture modeling tool 38 can simulate fracture design to determine fracture conductivity and predict production characteristics. For example, the tool 38 can use a pseudo three-dimensional (PSD) hydraulic fracturing simulator for modeling the fracture, perform sensitivity studies to choose the best fracture design, predict simultaneous growth of multiple fractures in the same or different perforated intervals, interface with the fracture control module 34 to monitor and analyze frac jobs in real time, and develop a proppant pumping schedule using a pump schedule generator (PSG) module 42 and/or an automatic pressure matching (APM) module 44. An initial model can be developed by the tool 38 based on data input from a module 46 from a closure test and/or calibration test run before the fracturing treatment, or other source for fracturing characteristics such as closure stress, fluid efficiency, fluid loss coefficient, fracture half-length, fracture height, Young's modulus, and so on. Job data are sent to the modeling tool 38 in real time, and if the analysis by the tool 38 indicates a need for design changes, the changes can be imported into the fracture control module 34 without interrupting the treatment.

Various software tools are commercially available for fracture modeling tool 38, either as licensable modules or as part of an overall fracturing system, such as, for example, the hydraulic fracturing design and evaluation engineering application available from Schlumberger Oilfield Services under the trade designation FRACCADE, which is available in an integrated suite of engineering applications for well construction, production and intervention available under the trade designation CADE OFFICE. For example, the FRACCADE modeling tool 38 is available with: a closure test/calibration module 46 under the trade designation DATAFRAC; a PSG module 42; an APM module 44; an optimization sub-module; a P3D simulator; an acid fracturing simulator; a multi-layered fracture sub-module; and so on; that can be used in an HPP job or can be appropriately modified by the skilled artisan for use in an HPP job. For example, the PSG module 42 can be modified with a dispersion algorithm to produce a pulsated proppant pumping schedule.

The design and updating of the model can include determining the amount of proppant for delivery. For example, an initial model can solve an optimization problem to determine the amount of proppant to be used to achieve particular fracture dimension. Results from the solved problem can then be used to develop an initial proppant placement schedule. As used herein, the term "proppant placement schedule" refers to a schedule for placing the proppant in the fracture and can include a pumping schedule, a perforation strategy, and the like or a combination thereof. A pumping schedule is a plan prepared to specify the sequence, type, content and volume of fluids to be pumped during a specific treatment. A perforation strategy is a plan to direct the flow of a well treatment fluid through certain perforations in a wellbore casing and/or to inhibit flow through other perforations and can include, for example, plugging and/or opening existing perforations or making new perforations to enhance conductivity and to control fracture growth.

The proppant placement schedule can include varying a proppant concentration profile in the treatment fluid. Further, the proppant concentration profile can be varied according to a dispersion method. For example, the model can include process control algorithms which can be implemented to vary surface proppant concentration profile to deliver a particular proppant slug concentration profile at perforation intervals. Under a normal pumping process, a slug of proppant injected into a wellbore will undergo dispersion and stretch and loose "sharpness" of the proppant concentration at the leading and tail edges of the proppant slug. For a uniform proppant concentration profile, the surface concentration profile can be solved by inverting a solution to a slug dispersion problem. Dispersion can thus be a mechanism which "corrects" the slug concentration profile from an initial surface value to a particular downhole profile.

With reference to E. L. Cussler, Diffusion: Mass Transfer in Fluid Systems, Cambridge University Press, pp. 89-93 (1984), an example of a system of equations that can be solved is shown below for a Taylor dispersion problem—laminar flow of a Newtonian fluid in a tube, where a solution is dilute, and mass transport is by radial diffusion and axial convection only. Virtually any fluid mechanics problem can be substituted for the above system, including turbulent or laminar flow, Newtonian or non-Newtonian fluids and fluids with or without particles. In practice, a downhole concentration profile will be defined, and equations solved in the inverse manner to determine initial conditions, for example, rates of addition for proppant, to achieve particular downhole slug properties.

The equations can include, for example, $$\bar{c}_1 = \frac{\frac{M}{\pi R_0^2}}{\sqrt{4\pi E_z t}} e^{-(z-v^0 t)^2/4E_z t}$$

where M is total solute in a pulse (the material whose concentration is to be defined at a specific downhole location), $R_0$ is the radius of a tube through which a slug is traveling, z is the distance along the tube, $v^0$ is the fluid's velocity, and t is time. A dispersion coefficient Ez can be shown to be, $$Ez = \frac{(R_0 v^0)^2}{48D}$$

where D is a diffusion coefficient. A system of equations that yield this solution follows. Variable definitions can be found in E. L. Cussler, Diffusion: Mass Transfer in Fluid Systems, Cambridge University Press, pp. 89-93 (1984).

$$\frac{\partial \bar{c}_1}{\partial \tau} = \left(\frac{v^0 R_0}{48D}\right)\frac{\partial^2 \bar{c}_1}{\partial \zeta^2}$$

subject to the conditions, $$\tau = 0, \text{ all } \zeta, \bar{c}_1 = \frac{M}{\pi R_0^2}\delta(\zeta)$$

$$\tau > 0, \zeta = \pm\infty, \bar{c}_1 = 0$$

$$\tau > 0, \zeta = 0, \frac{\delta \bar{c}_1}{\delta \tau} = 0$$

The system of equations above can be applied in general to design any downhole proppant concentration profile, slugged or continuous. The solution for a dispersion of granular material flow in a fluid down a wellbore can be inverted to calculate a corresponding surface concentration of proppant in the fracturing fluid. Process control technology can then take this surface concentration schedule and proportion the proppant accordingly. For example, the surface concentration schedule can be factored into the model, the proppant placement schedule adjusted to the model and proppant delivered according to the proppant placement schedule.

The pumping time of "no slug", for example when the proppant-lean fluid is pumped, is one of the key parameters in an HPP proppant placement schedule. The "no slug" parameter can control the distance between columns of pillars created in the fracture. A "no slug" time which is too high can result in a pinching point, an area in which the fracture is at least partially collapsed due to a lack of support between two columns of pillars. A pinch point, or pinching, can block fracture conductivity and, therefore, effect production.

Figure 3:
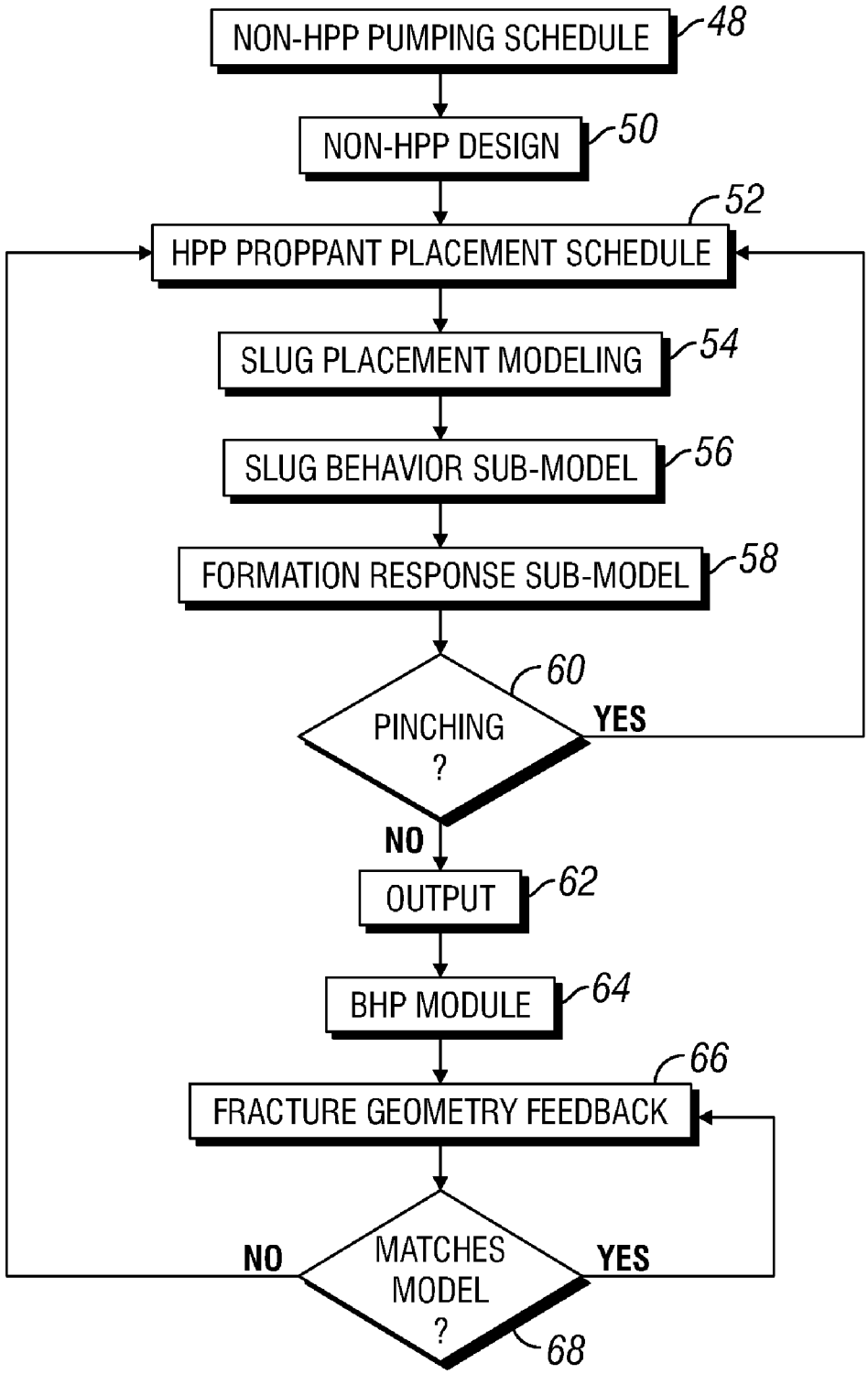
FIG. 3 schematically illustrates a computer software suite with a pinching correction according to an embodiment of the invention.

A schematic of an HPP computer software suite with a pinching correction according to an embodiment of the invention is illustrated in FIG. 3. A non-HPP proppant placement schedule 48 with total flow volumes can be an input for a non-HPP design 50, which can provide end-of-job (EOJ) data. An HPP proppant placement schedule 52 can use the non-HPP design 50 to provide both proppant slug timing and no-proppant slug timing. The HPP proppant placement schedule 52 can allow for slug placement modeling tool 54. Slug placement modeling tool 54 models the placement and estimation of the position and concentration of each slug, and represents each column of pillars as one proppant stage. A slug behavior sub-model 56 can receive EOJ zone properties and determine slug height. The slug height and position data from the slug behavior sub-model 56 can be used by a formation response sub-model 58 to determine a critical fracture width and make an analysis of pinch determination 60. Pinching might occur, for example, if the spacing between adjacent proppant pillars too great so that the fracture is allowed to close or pinch between the pillars. If pinch analysis 60 is affirmative, the formation response model 58 can communicate with the HPP proppant placement schedule 52 to update the no-proppant slug pumping time to inhibit pinching. In general, a shorter no-proppant slug time will space the pillars closer together. Conductivity parameters can be displayed as an output 62. A bottom hole pumping (BHP) module 64 can use the output 62, along with a BHP schedule to determine a bottom hole pumping schedule, which can subsequently be converted into a surface pumping schedule. The HPP proppant placement schedule 52 can continuously receive updates of fracture geometry feedback 66 for comparison with values estimated in the model 68 and updating in the event there is a deviation.

In a first order approximation the distance, L, between two neighboring columns of pillars in the fracture can be calculated by the following dependence relation:

$$L = \frac{t_{noslug} \cdot Q_{rate}}{2 \cdot w_{frac} \cdot H_{frac}}$$

where $t_{noslug}$ is the pumping time during which no proppant is pumped, $Q_{rate}$ is the pump flowrate, $w_{frac}$ is the fracture width and $H_{frac}$ is the fracture height. The numerator thus includes the total volume of the no-proppant slug. In the denominator, a factor of 2 accounts for two fracture wings.

Pinching can occur whenever the distance L is smaller than a critical value, $L_{crit}$, wherein:

$$L_{crit} > \frac{t_{noslug} \cdot Q_{rate}}{2 \cdot w_{frac} \cdot H_{frac}}$$

The two parameters in the numerator on the right side of the above equation can be controlled during treatment, while the two in the denominator are not controlled and can change during treatment.

The consequences of pinching can be dramatic. Overall fracture conductivity can be considered as a chain of hydraulic conductivities of different parts of the fracture. Thus, the overall conductivity can be governed by the conductivity of a less-conducted fracture part. In the case of pinching, the fracture conductivity can be equal to the conductivity of the area where pinching occurred.

A simplified equation can be used to calculate fracture conductivity. The fracture conductivity is proportional to the third power of fracture width $$k \sim w^3$$

where k is the fracture conductivity and w is the fracture width.

In a pinching area, fracture width can be of the order of 0.05 mm or less, with this width due to the natural roughness of the fracture walls. In extreme cases where there is little to no wall roughness, the fracture width is essentially equal to zero (0), as is the effective fracture conductivity.

Figure 4:
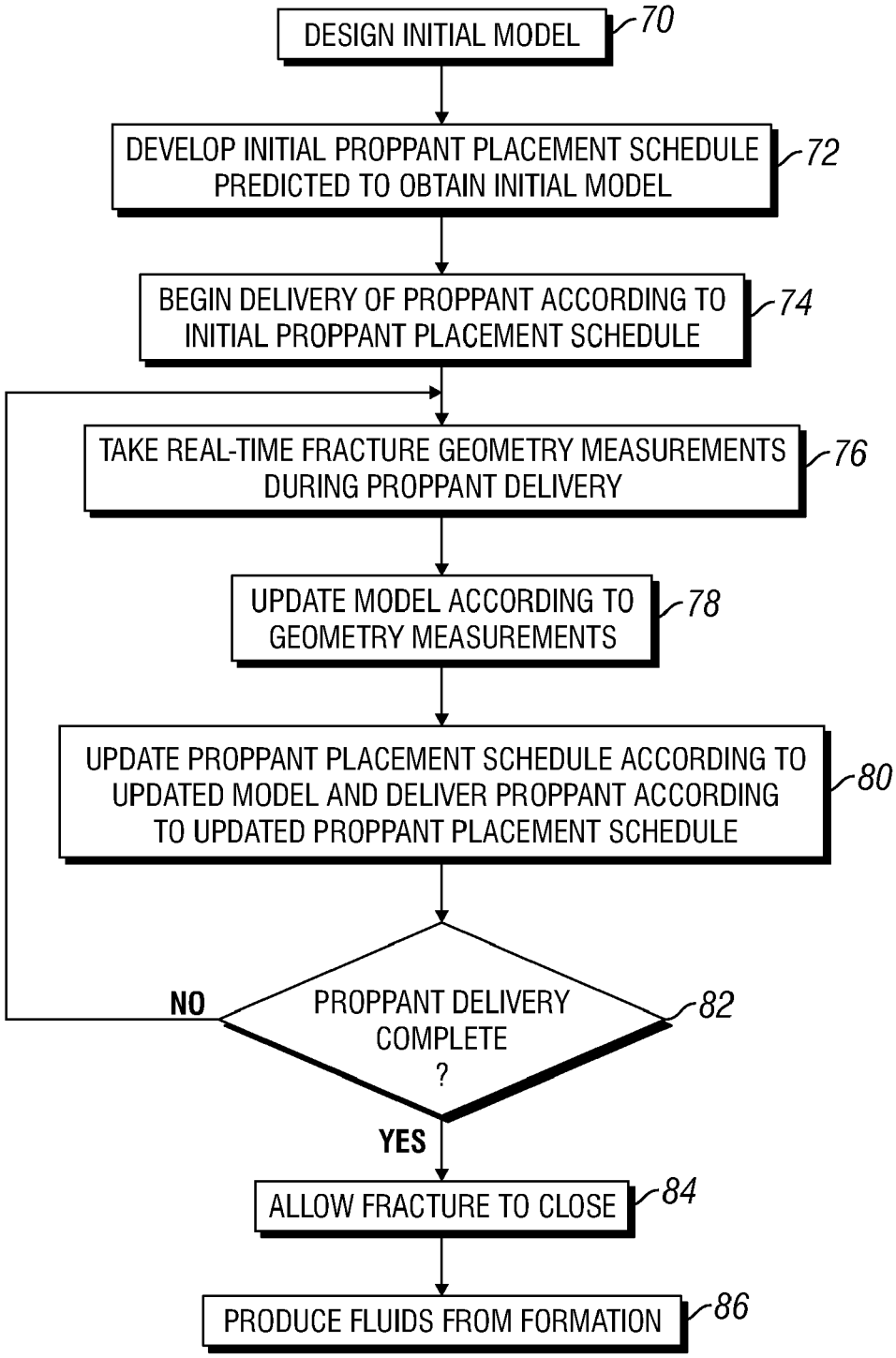
FIG. 4 schematically illustrates a sequence of steps for HPP in a subterranean formation according to an embodiment of the invention.

A simplified sequence of steps in an embodiment of the method of the invention is illustrated in FIG. 4. An initial model for heterogeneous proppant placement in a fracture in the formation can be designed in step 70, for example, with the aid of a computer modeling software package as discussed above. An initial proppant placement schedule can then be developed in step 72 for delivering proppant and treatment fluid to the fracture predicted to obtain the initial model. In step 74, delivery of the proppant to the fracture can then begin according to the initial proppant placement schedule. Real-time fracture geometry measurements can be taken in step 76 during the proppant delivery, for example, using an array of seismic sensors in communication with a fracture geometry software package as previously described. The model is updated in step 78 taking the geometry measurements into account. In operation 80, the proppant placement schedule is updated as required according to the updated model and the proppant delivered according to the updated proppant placement schedule. If the proppant delivery is not complete at decision 82, an automatic loop can repeat a sub-sequence of the real-time fracture geometry measurements in step 76, updating the model according to the geometry measurements in step 78, and updating the proppant placement schedule according to the updated model and delivering proppant according to the updated proppant placement schedule in step 80. If the proppant delivery is complete at decision 82, the fracture can be allowed to close in step 84 and fluids produced from the formation in step 86.

The mechanical properties of the pillars expected to form and of the formation such as, for example, Young's modulus, Poisson's ratio, formation effective stress, and the like can have a large impact on the fracture modeling and treatment design. For example, an optimization problem according to the formation mechanical properties can be solved during the design of an initial model to maximize the open channel volume within a fracture.

Young's modulus refers to an elastic constant which is the ratio of longitudinal stress to longitudinal strain and is symbolized by E. It can be expressed mathematically as follows: $E=(F/A)/(\Delta L/L)$, where E=Young's modulus, F=force, A=area, $\Delta L$=change in length, and L=original area.

Poisson's ratio is an elastic constant which is a measure of the compressibility of material perpendicular to applied stress, or the ratio of latitudinal to longitudinal strain. Poisson's ratio can be expressed in terms of properties that can be measured in the field, including velocities of P-waves and S-waves as follows: $\sigma=\frac{1}{2}(V_p^2-2V_s^2)/(V_p^2-V_s^2)$, where $\sigma$=Poisson's ratio, $V_P$=P-wave velocity and $V_s$=S-wave velocity. Effective stress, also know as "effective pressure" or "intergranular pressure", refers to the average normal force per unit area transmitted directly from particle to particle of a rock or soil mass.

Figure 5:
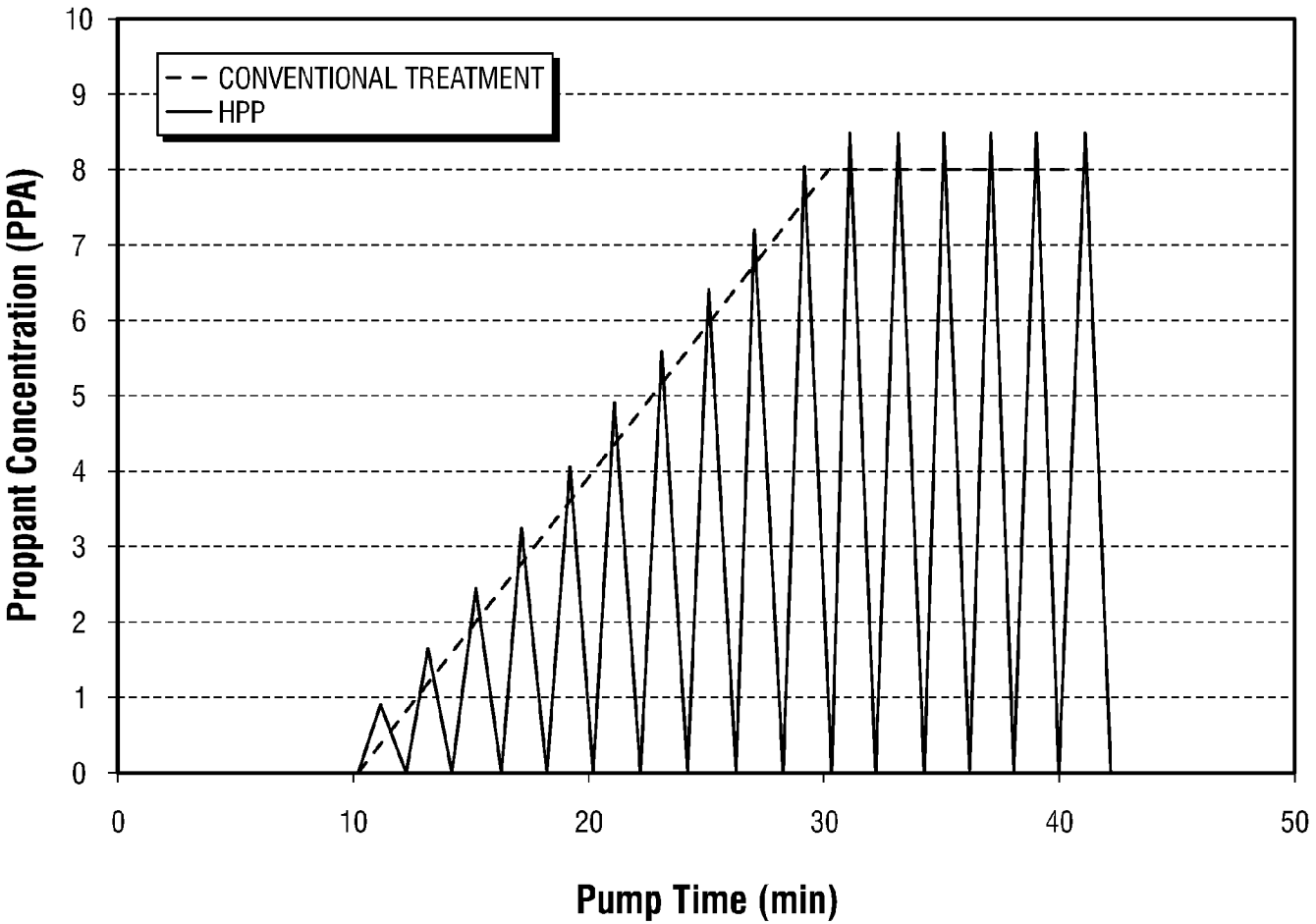
FIG. 5 graphically compares the proppant concentration in the proppant placement schedule for the fracturing treatment fluid of conventional fracturing using continuously increasing proppant injection versus fracturing with HPP using a pulsed proppant injection.
Figure 6:
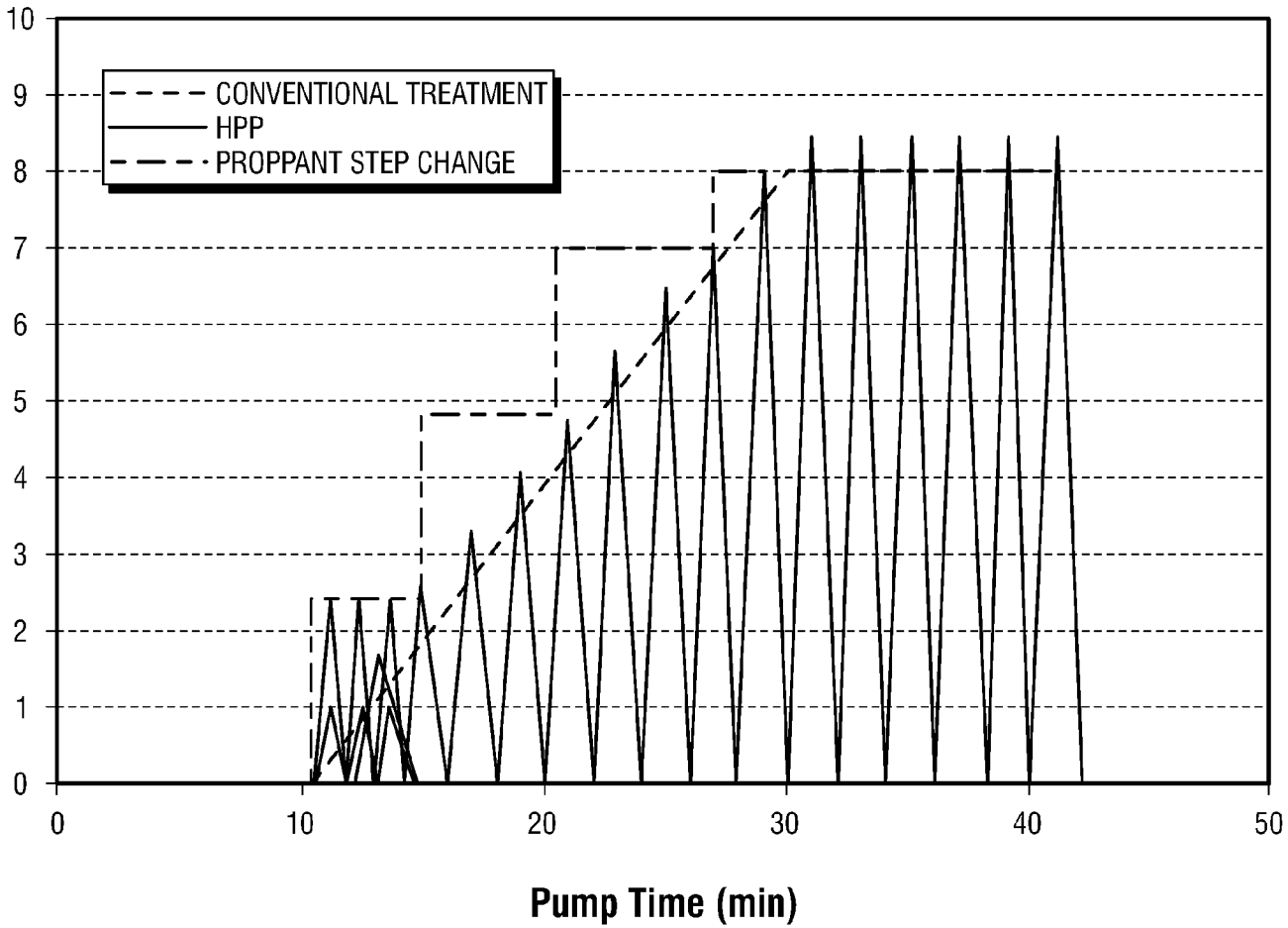
FIG. 6 graphically compares the proppant concentration in the proppant placement schedule for the fracturing treatment fluid of conventional fracturing using step change proppant injection versus fracturing with HPP using a pulsed proppant injection.

Scheduling and placement of the proppant during the HPP hydraulic fracture treatment can be different than traditional treatments. In HPP treatments, slugging the proppant can aid in correctly placing clusters in various locations in the fracture. For example, the proppant placement schedule can include slugs of proppant alternated with a proppant-lean fluid, for example "no slug" fluids, as illustrated in the HPP examples of FIGS. 5 and 6 wherein the alternating proppant slug and proppant-lean fluid technique is compared with the techniques of continuously increasing proppant injection and step change proppant injection, respectively. Proppant-lean fluids can include fluids with some concentration of proppant, though the concentration of proppant in the proppant-lean fluid is less than the concentration of proppant in the proppant slug.

Heterogeneous proppant placement for open channels in a proppant pack can be achieved by applying techniques such as addition of a heterogeneity trigger to the treatment fluid while pumping. The treatment fluid can include a chemical reactant heterogeneity trigger, a physical heterogeneity trigger such as fibers or a combination thereof. In some treatments, a trigger may be added periodically.

The geometric measurements can include tilt, pressure, acoustic, and seismic monitoring, and the like or a combination thereof, as previously mentioned. Passive seismic monitoring of the subsurface of the earth using temporarily deployed downhole sensor arrays is a technique that has found use in the HIM business.

When the fracture is allowed to close, the presence of pillars can concentrate stress at pillar edges and at the midpoint between pillars. These stress concentrations can produce microseismic events during the closure process, and in some instances can concentrate microseismic events in the vicinity of pillars. Thus, the pillars resulting from heterogeneous proppant placement, along with the ability to monitor the pillars using microseismic techniques, can lead to improved resolution of hydraulic fracture imaging.

The design and updating of a model can include determining fracture dimensions, including for example, fracture dimensions supplied from HFM. Further, the model can be updated with material balance calculations, pressure response measurements, and the like or a combination thereof. For example, the previously mentioned hydraulic fracturing design and evaluation engineering application FRACCADE can provide sophisticated modeling of the fracture growth based on material balance calculations and pressure response and microseismic measurements.

When the model is updated, the proppant placement schedule can be updated according to updated model. For example, the FRACCADE PSG module can automatically update the proppant placement schedule based on the updated model.

U.S. Pat. No. 6,776,235 (England) discloses a method for hydraulically fracturing a subterranean formation to form proppant clusters as pillars and is hereby incorporated by reference herein. In most cases, a hydraulic fracturing treatment consists in pumping a proppant-free viscous fluid, or pad, usually water with some fluid additives to generate high viscosity, into a well faster than the fluid can escape into the formation so that the pressure rises and the rock breaks, creating artificial fracture and/or enlarging existing fracture. Then, a proppant such as sand is added to the fluid to form a slurry that is pumped into the fracture to prevent it from closing when the pumping pressure is released. The proppant transport ability of a base fluid depends on the type of viscosifying additives added to the water base.

Water-base fracturing fluids with water-soluble polymers added to make a viscosified solution are widely used in the art of fracturing. Since the late 1950s, more than half of the fracturing treatments have been conducted with fluids comprising guar gums, high-molecular weight polysaccharides composed of mannose and galactose sugars, or guar derivatives such as hydropropyl guar (HPG), carboxymethyl guar (CMG) and carboxymethylhydropropyl guar (CMHPG). Crosslinking agents based on boron, titanium, zirconium or aluminum complexes are typically used to increase the effective molecular weight of the polymer and make them better suited for use in high-temperature wells.

To a smaller extent, cellulose derivatives such as hydroxyethylcellulose (HEC) or hydroxypropylcellulose (HPC) and carboxymethylhydroxyethylcellulose (CMHEC) are also used, with or without crosslinkers. Xanthan and scleroglucan, two biopolymers, have been shown to have excellent proppant-suspension ability even though they are more expensive than guar derivatives and therefore used less frequently. Polyacrylamide and polyacrylate polymers and copolymers are used typically for high-temperature applications or friction reducers at low concentrations for all temperatures ranges.

Polymer-free, water-base fracturing fluids can be obtained using viscoelastic surfactants. These fluids are normally prepared by mixing in appropriate amounts suitable surfactants such as anionic, cationic, nonionic and zwitterionic surfactants. The viscosity of viscoelastic surfactant fluids is attributed to a three dimensional structure formed by the components in the fluids. When the concentration of surfactants in a viscoelastic fluid significantly exceeds a critical concentration, and in some cases in the presence of an electrolyte, surfactant molecules aggregate into species such as micelles, which can interact to form a network exhibiting viscous and elastic behavior.

Cationic viscoelastic surfactants—typically consisting of long-chain quaternary ammonium salts such as cetyltrimethylammonium bromide (CTAB)—have been of primarily commercial interest in wellbore fluid. Common reagents that generate viscoelasticity in the surfactant solutions are salts such as ammonium chloride, potassium chloride, sodium chloride, sodium salicylate and sodium isocyanate and nonionic organic molecules such as chloroform. The electrolyte content of surfactant solutions can also affect their viscoelastic behavior. Reference is made for example to U.S. Pat. Nos. 4,695,389, 4,725,372, 5,551,516, 5,964,295, and 5,979,557. However, fluids comprising this type of cationic viscoelastic surfactants usually tend to lose viscosity at high brine concentration (about 1 kilogram per liter or more). Therefore, these fluids have seen limited use as gravel-packing fluids or drilling fluids, or in other applications requiring heavy fluids to balance well pressure. Anionic viscoelastic surfactants are also used.

It is also known from European Patent Specification EP 0 993 334 B1, to impart viscoelastic properties using amphoteric/zwitterionic surfactants and an organic acid, salt and/or inorganic salt. The surfactants are for instance dihydroxyl alkyl glycinate, alkyl ampho acetate or propionate, alkyl betaine, alkyl amidopropyl betaine and alkylamino mono- or di-propionates derived from certain waxes, fats and oils. The surfactants may be used in conjunction with an inorganic water-soluble salt or organic additives such as phthalic acid, salicylic acid or their salts. Amphoteric/zwitterionic surfactants, in particular those comprising a betaine moiety are useful at temperature up to about 150° C. and are therefore of particular interest for medium to high temperature wells.

Other amphoteric viscoelastic surfactants are also suitable, such as those described in U.S. Pat. No. 6,703,352, for example amine oxides. Yet other exemplary viscoelastic surfactant systems include those described in U.S. Patent Application Nos. 2002/0147114, 2005/0067165, and 2005/0137095, for example amidoamine oxides. These four references are hereby incorporated in their entirety. Mixtures of zwitterionic surfactants and amphoteric surfactants are suitable. An example is a mixture of about 13% isopropanol, about 5% 1-butanol, about 15% ethylene glycol monobutyl ether, about 4% sodium chloride, about 30% water, about 30% cocoamidopropyl betaine, and about 2% cocoamidopropylamine oxide.

The treatment can consist of alternating viscoelastic-base fluid stages (or a fluid having relatively poor proppant capacity, such as a polyacrylamide-based fluid, in particular at low concentration) with stages having high polymer concentrations. Preferably, the pumping rate is kept constant for the different stages but the proppant-transport ability may be also improved (or alternatively degraded) by reducing (or alternatively increasing) the pumping rate.

Any proppant (gravel) can be used, provided that it is compatible with the base and the bridging-promoting materials if the latter are used, the formation, the fluid, and the desired results of the treatment. Such proppants (gravels) can be natural or synthetic, coated, or contain chemicals; more than one can be used sequentially or in mixtures of different sizes or different materials. Proppants and gravels in the same or different wells or treatments can be the same material and/or the same size as one another and the term "proppant" is intended to include gravel in this discussion. In general the proppant used will have an average particle size of from about 0.15 mm to about 2.5 mm, more particularly, but not limited to typical size ranges of about 0.25-0.43 mm, 0.43-0.85 mm, 0.85-1.18 mm, 1.18-1.70 mm, and 1.70-2.36 mm. Normally the proppant will be present in the slurry in a concentration of from about 0.12 kg proppant added to each L of carrier fluid to about 3 kg proppant added to each L of carrier fluid, preferably from about 0.12 kg proppant added to each L of carrier fluid to about 1.5 kg proppant added to each L of carrier fluid.

Embodiments of the invention may also include placing proppant particles that are substantially insoluble in the fluids of the formation. Proppant particles carried by the treatment fluid remain in the fracture created, thus propping open the fracture when the fracturing pressure is released and the well is put into production. [Any proppant (gravel) can be used, provided that it is compatible with the base and the bridging-promoting materials if the latter are used, the formation, the fluid, and the desired results of the treatment. Such proppants (gravels) can be natural or synthetic, coated, or contain chemicals; more than one can be used sequentially or in mixtures of different sizes or different materials. Proppants and gravels in the same or different wells or treatments can be the same material and/or the same size as one another and the term "proppant" is intended to include gravel in this discussion. Proppant is selected based on the rock strength, injection pressures, types of injection fluids, or even completion design. Preferably, the proppant materials include, but are not limited to, sand, sintered bauxite, glass beads, ceramic materials, naturally occurring materials, or similar materials. Mixtures of proppants can be used as well. Naturally occurring materials may be underived and/or unprocessed naturally occurring materials, as well as materials based on naturally occurring materials that have been processed and/or derived. Suitable examples of naturally occurring particulate materials for use as proppants include, but are not necessarily limited to: ground or crushed shells of nuts such as walnut, coconut, pecan, almond, ivory nut, brazil nut, etc.; ground or crushed seed shells (including fruit pits) of seeds of fruits such as plum, olive, peach, cherry, apricot, etc.; ground or crushed seed shells of other plants such as maize (e.g., corn cobs or corn kernels), etc.; processed wood materials such as those derived from woods such as oak, hickory, walnut, poplar, mahogany, etc., including such woods that have been processed by grinding, chipping, or other form of particalization, processing, etc, some nonlimiting examples of which are proppants made of walnut hulls impregnated and encapsulated with resins. Further information on some of the above-noted compositions thereof may be found in Encyclopedia of Chemical Technology, Edited by Raymond E. Kirk and Donald F. Othmer, Third Edition, John Wiley & Sons, Volume 16, pages 248-273 (entitled "Nuts"), Copyright 1981, which is incorporated herein by reference. By selecting proppants having a contrast in one of such properties such as density, size and concentrations, different settling rates will be achieved.

"Waterfrac" treatments employ the use of low cost, low viscosity fluids in order to stimulate very low permeability reservoirs. The results have been reported to be successful (measured productivity and economics) and rely on the mechanisms of asperity creation (rock spalling), shear displacement of rock and localized high concentration of proppant to create adequate conductivity. It is the last of the three mechanisms that is mostly responsible for the conductivity obtained in "waterfrac" treatments. The mechanism can be described as analogous to a wedge splitting wood.

Embodiments can aid in redistribution of the proppant by affecting the wedge dynamically during the treatment. For this example a low viscosity waterfrac fluid is alternated with a low viscosity viscoelastic fluid which has excellent proppant transport characteristics. The alternating stages of viscoelastic fluid will pick up, re-suspend and transport some of the proppant wedge that has formed near the wellbore due to settling after the first stage. Due to the viscoelastic properties of the fluid the alternating stages pick up the proppant and form localized clusters (similar to the wedges) and redistribute them farther up and out into the hydraulic fracture.

The fluid systems can be alternated many times to achieve varied distribution of the clusters in the hydraulic fracture. This phenomenon will create small clusters in the fracture that can become pillars which help keep more of the fracture open and create higher overall conductivity and effective fracture half-length.

By using a combination of fluids that will pick-up, transport and redistribute the proppant it is possible to remediate the negative impact of a short effective fracture half-length and may even possibly eliminate the fracture closing across from high stress layers. The fracture can close across the higher stress layers because of lack of vertical proppant coverage in the fracture.

There are many different combinations of fluid systems that can be used to achieve the desired results based on reservoir conditions. In the least dramatic case it would be beneficial to pick-up sand from the bank that has settled and move it laterally away from the wellbore. The various combinations of fluids and proppants can be designed based on individual well conditions to obtain the optimum well production.

EXAMPLES

In the following tables, Table 1 illustrates a non-HPP pumping schedule and Table 2 illustrates a non-automated HPP pumping schedule. The total slurry volume is 886.1 bbl and total pump time is 40.4 minutes in both cases. In both of these conventional applications, the pumping schedule is fixed and followed for the particular job.

TABLE 1

Non-HPP Pumping Schedule

| Stage Name | Pump Rate, l/min (bbl/min) | Fluid Volume, l (gal) | Proppant Concentration, ppa | Proppant Mass, kg (lb) | Slurry Volume, l (bbl) | Pump Time, min |
|---|---|---|---|---|---|---|
| Pad | 3500 (22) | 36,000 (9500) | 0 | 0 (0) | 35,960 (226.2) | 10.3 |
| 2.0 PPA | 3500 (22) | 7600 (2003) | 2 | 1817 (4006) | 8300 (52) | 2.4 |
| 4.0 PPA | 3500 (22) | 11,410 (3013) | 4 | 5467 (12,052) | 13,400 (84.7) | 3.9 |
| 6.0 PPA | 3500 (22) | 15,200 (4024) | 6 | 10,951 (24,144) | 19,360 (121.8) | 5.5 |
| 8.0 PPA | 3500 (22) | 28,590 (7553) | 8 | 27,408 (60,424) | 38,940 (244.9) | 11.1 |
| 10.0 PPA | 3500 (22) | 11,450 (3025) | 10 | 13,721 (30,250) | 16,630 (104.6) | 4.8 |
| Flush | 3500 (22) | 8250 (2180) | 0 | 0 (0) | 8250 (51.9) | 2.4 |

TABLE 2

Conventional HPP Pumping Schedule

| Stage Name | Pump Rate, l/min (bbl/min) | Proppant Concentration, ppa | Slurry Volume, l (bbl) | Pump Time, min | Slug Time, sec | No-Slug Time, sec | Number of Cycles |
|---|---|---|---|---|---|---|---|
| Pad | 3500 (22) | 0 | 35,960 (226.2) | 10.3 | N/A | N/A | N/A |
| 2.0 PPA | 3500 (22) | 2 | 8300 (52) | 2.4 | 19.20 | 0.00 | 5 |
| 4.0 PPA | 3500 (22) | 4 | 13,400 (84.7) | 3.9 | 15.60 | 9.60 | 9 |
| 6.0 PPA | 3500 (22) | 6 | 19,360 (121.8) | 5.5 | 16.50 | 10.40 | 12 |
| 8.0 PPA | 3500 (22) | 8 | 38,940 (244.9) | 11.1 | 17.37 | 11.00 | 23 |
| 10.0 PPA | 3500 (22) | 10 | 16,630 (104.6) | 4.8 | 17.28 | 11.58 | 10 |
| Flush | 3500 (22) | 0 | 8250 (51.9) | 2.4 | N/A | N/A | N/A |

Unlike the fixed pumping schedules of the prior art, embodiments of the present invention can automatically update the pumping schedule to adapt to the changing conditions of the treatment. For example, suppose during the HPP treatment according to Table 2 as the initial pumping schedule, a response from measurement systems indicates that the fracture height has increased by 20% above the expected fracture height used to develop the Table 2 schedule. To compensate for the fracture height increase, the no-proppant slug time/pumping rate product can be reduced by a factor of 0.83 (1.0/1.2~0.83) to maintain the distance between slugs below the $L_{crit}$ critical limit. If the pumping rate is kept constant at 3500 l/min, the 20% fracture height increase would result in adjusted no-slug times of 8.63 (10.40*0.83) and 9.61 (11-58*0,83) during the stages of 6.0 and 10.0 PPA, respectively. Without automated control during HPP treatment, the volume of no-proppant slug to be pumped is overestimated, resulting in the fracture walls pinching between two columns of pillars. In a pinching area, fracture width can be of the order of 0.05 mm or less, with this width due to the natural roughness of the fracture walls. In extreme cases where there is little to no wall roughness, the fracture width is essentially equal to zero (0), as is the effective fracture conductivity.

If a properly executed automated HPP treatment obtains a minimum fracture width to be equal to about 0.5 mm, the fracture conductivity can be estimated to be 0.1 $mm^3$ [$k \sim w^3 \sim (0.5\ mm)^3$]. If a pinching area fracture width is only 0.05 mm, the fracture conductivity can be estimated to be 0.0001 $mm^3$ [$k \sim w^3 \sim (0.05\ mm)^3$]. Thus, the non-pinched automated HPP treatment can yield a 1000 fold improvement in conductivity over the pinched prior art treatment.

What is claimed is:

1. A method of heterogeneous proppant placement in a subterranean formation, comprising the steps of:

(a) designing an initial model for a heterogeneous proppant placement in a fracture in the formation;

(b) developing an initial proppant placement schedule for delivering proppant and treatment fluid to the fracture predicted to obtain the initial model;

(c) beginning delivery of the proppant to the fracture according to the initial proppant placement schedule;

(d) taking real-time fracture geometry measurements during the proppant delivery;

(e) updating the model according to the geometry measurements;

(f) updating the proppant placement schedule according to the updated model and delivering the proppant according to the updated proppant placement schedule; and (g) repeating steps (d) through (f) in real-time until the proppant delivery is complete.

2. The method of claim 1 wherein parameters for the model comprise formation mechanical properties selected from the group consisting of Young's modulus, Poisson's ratio, formation effective stress and a combination thereof.

3. The method of claim 1 wherein the proppant is delivered in slugs.

4. The method of claim 3 wherein the proppant placement schedule comprises slugs of proppant alternated with a proppant-lean fluid.

5. The method of claim 1 comprising phasing the delivery of the proppant in a programmable optimum density (POD) blender.

6. The method of claim 1 comprising phasing the delivery of the proppant in a tub blender.

7. The method of claim 1 comprising varying a fluid delivery flowrate.

8. The method of claim 1 wherein the delivery comprises automatically controlling pumping and blending of proppant and treatment fluid.

9. The method of claim 1 wherein the design and updating of the model comprise determining the amount of proppant for delivery.

10. The method of claim 1 wherein the design and updating of the model comprise determining the fracture dimensions.

11. The method of claim 1 wherein the treatment fluid comprises a heterogeneity trigger for heterogeneous proppant placement.

12. The method of claim 11 wherein the heterogeneity trigger comprises a chemical reactant heterogeneity trigger.

13. The method of claim 11 wherein the heterogeneity trigger comprises a physical heterogeneity trigger.

14. The method of claim 11 wherein the heterogeneity trigger comprises a fibrous heterogeneity trigger.

15. The method of claim 1 further comprising forming clusters of proppant with open channels between the clusters.

16. The method of claim 1 further comprising delivering fibers to the fracture.

17. The method of claim 1 wherein the proppant placement schedule further comprises varying a proppant concentration profile in the treatment fluid.

18. The method of claim 17 wherein the proppant concentration profile is varied according to a dispersion method.

19. The method of claim 17 wherein the proppant concentration profile is varied to inhibit the formation of pinch points.

20. The method of claim 1 wherein the geometric measurements comprise seismic monitoring.

21. The method of claim 1 wherein the updating the model comprises determining fracture growth according to material balance calculations, pressure response measurements, seismic event measurements or a combination thereof.

22. The method of claim 1 further comprising allowing the fracture to close.

23. The method of claim 1 further comprising producing fluids from the formation.

24. A system for heterogeneous proppant placement in a fracture in a subterranean formation, comprising:

a delivery system for delivering proppant and treatment fluid to the fracture;

a sensor for measuring geometry of the fracture;

a computer in communication with the sensor, comprising:

a software tool for real-time design of a model for heterogeneous proppant placement in the fracture based on data from the sensor measurements; and a software tool for developing and updating a proppant placement schedule for delivering the proppant and treatment fluid to the fracture corresponding to the model; and a control link between the computer and the delivery system for delivery of the proppant and treatment fluid according the updated proppant placement schedule.

25. The heterogeneous proppant placement system of claim 24 wherein the delivery system comprises a pump.

26. The heterogeneous proppant placement system of claim 24 wherein the delivery system comprises a mixer.

27. The heterogeneous proppant placement system of claim 24 wherein the delivery system comprises a blender.

28. The heterogeneous proppant placement system of claim 27 wherein the blender comprises a programmable optimum density (POD) blender.

29. The heterogeneous proppant placement system of claim 27 wherein the blender comprises a tub blender.

30. The heterogeneous proppant placement system of claim 24 wherein the sensor is selected from the group consisting of pressure sensor, seismic sensor, tilt sensor, radioactivity sensor, magnetic sensor and electromagnetic sensor.

31. The heterogeneous proppant placement system of claim 24 wherein the sensor comprises an array of sensors.

32. The heterogeneous proppant placement system of claim 24 wherein the sensor comprises a noisy particulate material and a sensor for detecting a detonation, ignition or exothermic reaction of the noisy particulate material.

33. The heterogeneous proppant placement system of claim 24 wherein the proppant comprises a device for actively transmitting data for locating the position of the transmitting device and the sensor comprises a sensor for receiving the transmitted location data.

34. A method, comprising:

(a) designing an initial model for a heterogeneous proppant placement in a fracture in a formation, wherein the heterogeneous proppant placement includes clusters of high proppant concentration and open channels between the clusters;

(b) developing an initial proppant placement schedule for delivering proppant and treatment fluid to the fracture predicted to obtain the initial model;

(c) beginning delivery of the proppant to the fracture according to the initial proppant placement schedule, wherein the proppant placement schedule comprises alternating proppant-rich slugs and proppant lean stages;

(d) taking real-time fracture geometry measurements during the proppant delivery;

(e) updating the model according to the geometry measurements;

(f) updating the proppant placement schedule according to the updated model and delivering the proppant according to the updated proppant placement schedule; and (g) repeating steps (d) through (f) in real-time until the proppant delivery is complete.

35. The method of claim 34, wherein developing the initial proppant placement schedule comprises determining a downhole proppant slug profile, inverting a solution to a slug dispersion problem, and determining a surface proppant concentration for the proppant-rich slugs according to the downhole proppant slug profile and the solution to the slug dispersion problem.

36. The method of claim 35, wherein the solution to the slug dispersion problem utilizes a dispersion coefficient Ez according to:

$$Ez=(v^0R_0)^2/48D;$$

wherein $v^0$ is a velocity of the treatment fluid, $R_0$ is a radius of a treatment tube, and D is a diffusion coefficient.

37. The method of claim 35, wherein the heterogeneous proppant placement comprises proppant pillars in the fracture, the method further comprising allowing the fracture to close, monitoring the formation for micro-seismic events, determining a geometry of the fracture according to the micro-seismic events, and updating the initial model according to the geometry of the fracture.

38. The method of claim 34, wherein updating the proppant placement schedule includes constraining a proppant lean stage to a relationship:

$$t_{noslug}*Q_{rate}<2*w_{frac}*H_{frac}$$

wherein $t_{noslug}$ is a time to pump the proppant lean stage, where $Q_{rate}$ is a pumping rate of the proppant lean stage, wherein $w_{frac}$ is a width of the fracture, and wherein $H_{frac}$ is a height of the fracture.

39. The method of claim 38, wherein constraining the proppant lean stages to the relationship comprises adjusting at least one of the time to pump the proppant lean stage, the pumping rate of the proppant lean stage, and a fluid volume of the proppant lean stage.

40. The method of claim 34, wherein the heterogeneous proppant placement comprises a plurality of localized proppant clusters in the fracture.

41. The method of claim 40, wherein the proppant placement schedule further includes alternating a fracturing fluid between low viscosity waterfrac fluid and a low viscosity viscoelastic fluid.

* * * * *